US012638205B2

(12) United States Patent
Walsdorf et al.

(10) Patent No.: US 12,638,205 B2
(45) Date of Patent: May 26, 2026

(54) UNIVERSAL CONNECTOR FOR AIR CONDITIONING CONTROLLER

(71) Applicants: Daniel B. Walsdorf, Kiel, WI (US); Rockey Rojar, Austin, TX (US)

(72) Inventors: Daniel B. Walsdorf, Kiel, WI (US); Rockey Rojar, Austin, TX (US)

( * ) Notice: Subject to any disclaimer, the term of this patent is extended or adjusted under 35 U.S.C. 154(b) by 366 days.

(21) Appl. No.: 18/478,997

(22) Filed: Sep. 30, 2023

(65) Prior Publication Data

US 2025/0109874 A1 Apr. 3, 2025

(51) Int. Cl.
*F24F 11/63* (2018.01)

(52) U.S. Cl.
CPC ..... *F24F 11/63* (2018.01)

(58) Field of Classification Search
None
See application file for complete search history.

(56) References Cited

U.S. PATENT DOCUMENTS

| | | | | |
|---|---|---|---|---|
| 2022/0253078 | A1* | 8/2022 | Reeder | G05D 23/1923 |
| 2024/0053039 | A1* | 2/2024 | Zhao | F24F 11/52 |
| 2024/0200820 | A1* | 6/2024 | Broker | F24F 11/88 |
| 2024/0263825 | A1* | 8/2024 | Topf | F24F 11/50 |

* cited by examiner

*Primary Examiner* — Nathan L Laughlin

(57) ABSTRACT

A universal air conditioning controller is provided. The controller includes an interface for receiving wires from any of a plurality of different types of air conditioning systems. The controller determines the air conditioning type based on the connected wires and operates the air conditioning system based on its respective operational characteristics, modes, power requirements, and the like. The controller can connect to a network and can serve as a hub for connecting nearby devices to the network.

20 Claims, 5 Drawing Sheets

UNIVERSAL CONNECTOR FOR AIR CONDITIONING CONTROLLER

CROSS-REFERENCE TO RELATED APPLICATIONS

This application claims benefit of U.S. provisional patent application Ser. No. 63/411,653 filed Sep. 30, 2022. The aforementioned related patent application is herein incorporated by reference in its entirety.

TECHNICAL FIELD

Embodiments presented in this disclosure generally relate to air conditioning (AC) controllers. More specifically, embodiments disclosed herein relate to universal AC controllers adapted for use with a wide variety of AC systems.

BACKGROUND

Embodiments of the present disclosure relate to air conditioning controllers, specifically designed to enhance the efficiency, functionality, and user experience of air conditioning systems in various settings. Modern air conditioning controllers have evolved from simple mechanical thermostats to sophisticated electronic devices, incorporating advanced features and technologies to meet the ever-increasing demand for energy efficiency, environmental sustainability, and user convenience.

A wide variety of air conditioning controllers a presently available for different use cases, for example, for use in a home, office buildings or other large structures, recreational vehicles, boats, off-grid structures like cabins, and the like. Each type of air conditioning controller may use different types of inputs, wiring, commands and control signals, and the like. In some cases, different types of air conditioning controllers may exist even for the same use case based on different system designs of different manufacturers. Accordingly, consumer choice of air conditioning controllers may be limited to certain use cases and manufacturer designs.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate typical embodiments and are therefore not to be considered limiting; other equally effective embodiments are contemplated.

To facilitate understanding, identical reference numerals have been used, where possible, to designate identical elements that are common to the figures. It is contemplated that elements disclosed in one embodiment may be beneficially used in other embodiments without specific recitation.

DESCRIPTION OF EXAMPLE EMBODIMENTS

Overview

One embodiment presented in this disclosure provides a controller, comprising an interface comprising a plurality of ports configured to receive wires associated a plurality of different types of air conditioning systems, at least one processor, and a memory containing a program which when executed by the one or more computer processors performs an operation. The operation generally comprise detecting one or more wires of an air conditioning system coupled to the interface, determining an air conditioner type based on the detected one or more wires coupled to the interface, and operating the air conditioning system based on the determined air conditioner type.

Another embodiment presented in this disclosure provides a method, comprising detecting one or more wires of an air conditioning system coupled to an interface of a controller, wherein the interface is configured to receive wires associated a plurality of different types of air conditioning systems, determining an air conditioner type based on the detected one or more wires coupled to the interface, and operating the air conditioning system based on the determined air conditioner type.

Other embodiments in this disclosure provide non-transitory computer-readable mediums containing computer program code that, when executed by operation of one or more computer processors, performs operations in accordance with one or more of the above methods, as well as systems comprising one or more computer processors and one or more memories containing one or more programs which, when executed by the one or more computer processors, performs an operation in accordance with one or more of the above methods.

EXAMPLE EMBODIMENTS

Embodiments of the present disclosure provide methods, systems, and techniques related to universal air conditioning controllers capable for use with any type of air conditioning system.

Embodiments of the present disclosure provide a universal air conditioning controller. In one embodiment, the controller includes an interface for receiving wires from any one of a plurality of different types of air conditioning systems. The controller determines the air conditioning system type based on the connected wires and operates the air conditioning system based on its respective operational characteristics, modes, power requirements, and the like. In some embodiments, the controller may be a smart controller capable of connecting to a network. In one embodiment, the controller may be configured to connect to a network and serve as a hub for connecting nearby devices to the network.

Figure 1:
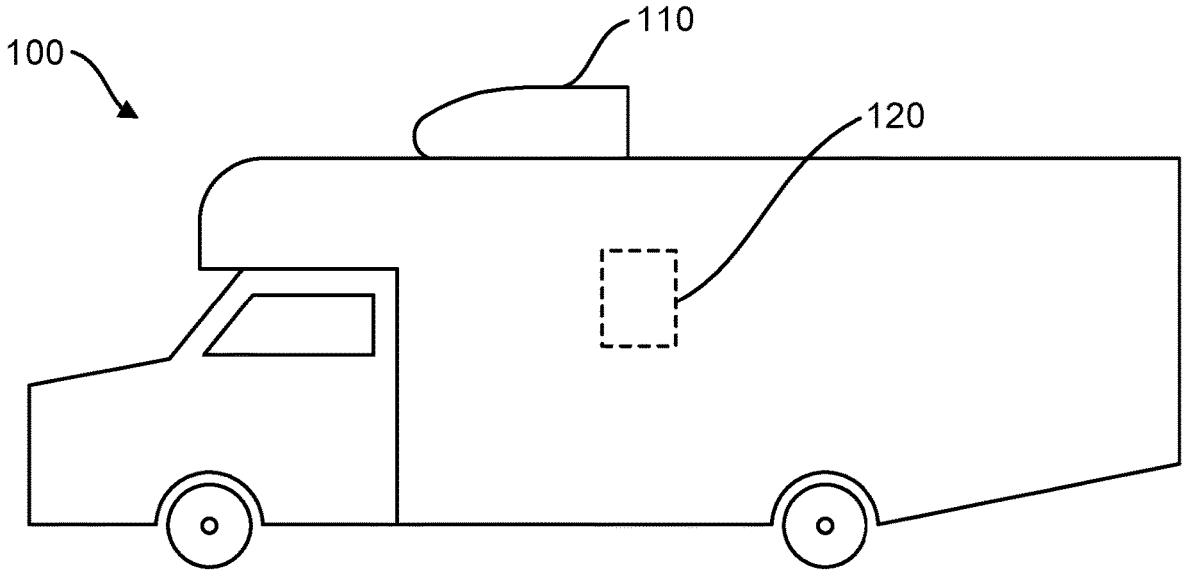
FIG. 1 depicts an example of a structure where climate control may be desired, according to some embodiments of the present disclosure.

FIG. 1 depicts an example of a structure 100 that is heated and/or cooled by air conditioning system 110, according to some embodiments of the present disclosure. The structure 100 is shown as a recreational vehicle in FIG. 1, however, in alternative embodiments, the structure 100 may be any type of structure where climate control is desired including, but not limited to, homes, boats, cabins, mobile homes, office buildings, warehouses, and the like.

The air conditioning system 110 may include a plurality of components for controlling climate within the space of the structure 100. For example, the air conditioning system 110 may include one or more of a compressor, an evaporator, a condenser, fans, pipes, valves, temperature sensors, filters, refrigerant, and the like for heating, cooling, and/or ventilation. While the air conditioning system 110 is shown as a single component placed adjacent to the structure 100 in FIG. 1, in alternative embodiments, the air conditioning system 110 components may be distributed at multiple locations which may be placed adjacent to or near an inside surface and/or an outside surface of the structure 100. Embodiments of the present invention can be used with air conditioning systems 110 that are ductless or ducted.

The air conditioning system 110 may be controlled by a thermostat or controller 120 which may be placed within the structure 100, according to some embodiments of the present disclosure. In one embodiment, the controller may be contained in a housing (not shown), capable of containing all the required components to operate the controller, and may be mounted on a wall or other surface. In one embodiment, the controller may include or be communicably coupled with one or more temperature sensors to determine a temperature within the structure 100. Based on a comparison between a measured temperature within the structure 100 and a desired temperature set by a user, the controller 120 may operate one or more components of the air conditioning system 110 to regulate one or more of heating, ventilation, and/or cooling by the air conditioning system 110 to achieve the desired temperature.

In one embodiment of the present disclosure, the controller 120 may be a smart thermostat capable of connecting to a network such as the internet to allow users to control and/or adjust settings, set temperature schedules, monitor usage, and the like. In some embodiments, the controller 120 may include interfaces to communicate with and/or control other devices such as smart phones, tablets, smart appliances, and the like. In some other embodiments, the controller 120 may be configured to connect to a cellular network and configured to provide nearby devices connectivity to the internet or other networks. In some embodiments, the controller 120 may employ machine learning algorithms to enhance one or more of cost savings, energy efficiency, optimized temperature schedules, and the like.

Figure 2:
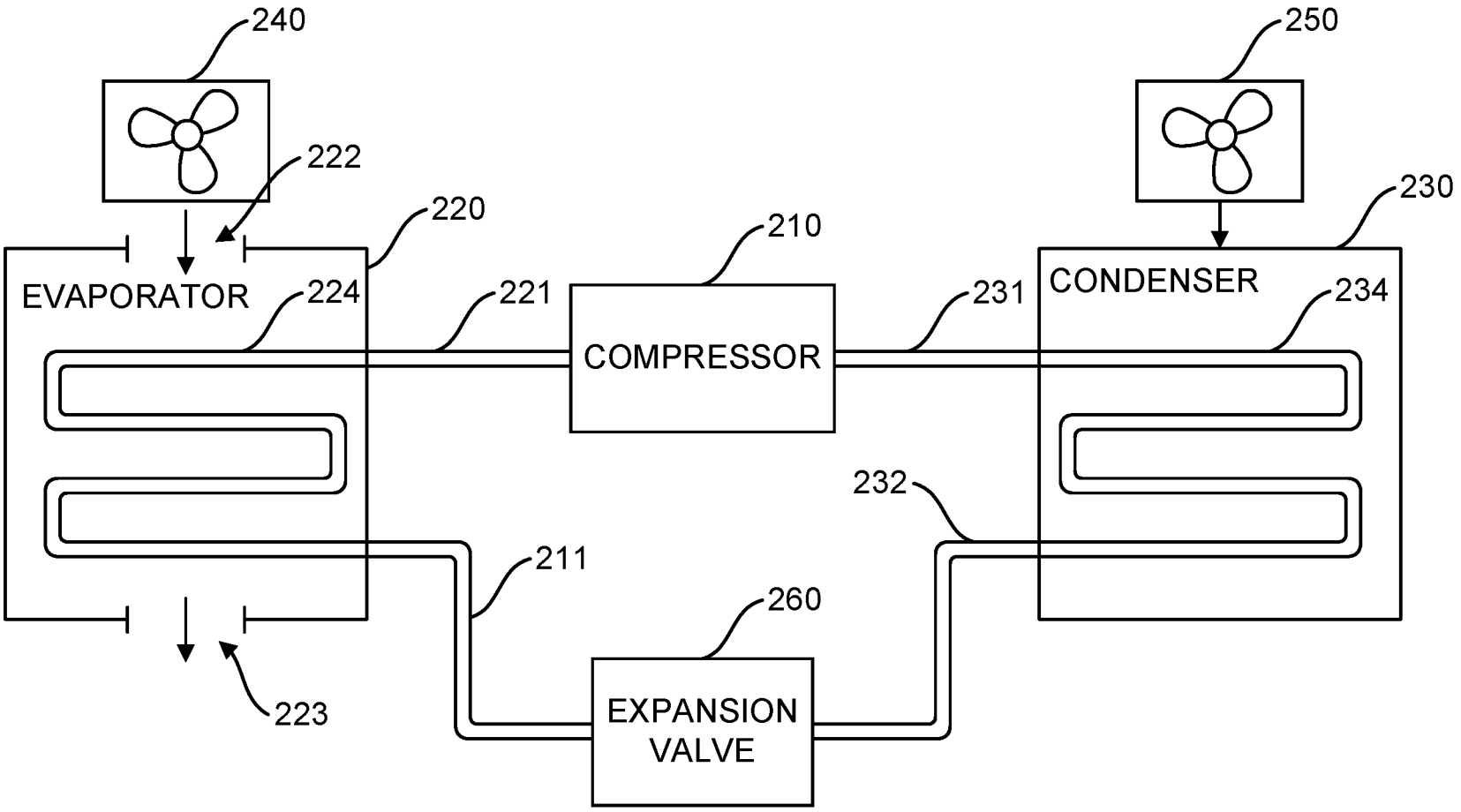
FIG. 2 depicts an example of an air conditioning system, according to some embodiments of the present disclosure.

FIG. 2 illustrates a more detailed view of an air conditioning system 110 according to some embodiments of the present disclosure. As shown in FIG. 2, the air conditioning system 110 may include a compressor 210, a condenser 220, an evaporator 230, fans 240 and 250, and an expansion valve 260.

In one embodiment of the present disclosure, the compressor 210 may be configured to receive a low pressure, low temperature refrigerant from the evaporator 220 via a pipe section 221 and compress the refrigerant into a high pressure and high temperature state. In one embodiment, the compressor may receive the refrigerant in a liquid or vapor state and convert the refrigerant into a gaseous state. According to some embodiments of the present disclosure, the compressor may transfer the high pressure, high temperature refrigerant to the condenser 230 via a pipe section 231, as shown in FIG. 2.

The condenser 231 may include a coil 234. A fan 250 may blow air over the coil 234, thereby causing the surfaces of the coil 234 to cool. As high pressure, high temperature refrigerant flows through the coil 234, the cooled surfaces of the coil 234 may absorb heat from the refrigerant, thereby causing the refrigerant, in some embodiments, to condense into a liquid state. In one embodiment of the present disclosure, the condenser 230 and fan 250 are placed outside the structure 100. In such embodiments, the air flowing over coil 234 may be retrieved from outside structure 100 and expelled outside of the structure 100.

In one embodiment of the present disclosure, the condensed refrigerant may be transferred from the condenser 230 to an expansion valve 260 via a pipe section 232. In some embodiments, the expansion valve 260 may be configured to reduce the pressure of the refrigerant, thereby causing the refrigerant to cool further. In one embodiment of the present disclosure, the expansion valve 260 may convert the refrigerant from a liquid to a gaseous state.

As shown in FIG. 2, the cooled refrigerant may be transferred from the expansion valve 260 to the evaporator 220 via a pipe section 222, according to some embodiments of the present disclosure. In one embodiment, the evaporator 220 may include an inlet vent 222, an outlet vent 223, and a coil 224. In one embodiment, the fan 240 may cause air from within the structure 100 to enter the evaporator 220 via the inlet vent 222. The air entering via the inlet vent 222 may flow over the coil 224 through which the cooled refrigerant flows, thereby cooling the air. The cooled air may then exit evaporator 220 via the outlet vent 223 and enter back into the structure 100, thereby cooling the interior of structure 100.

In one embodiment of the present disclosure, the flow of air over coil 224 may transfer heat from the air to the refrigerant flowing therethrough and cause the refrigerant to evaporate. The evaporated refrigerant may be transferred to compressor 210 via the pipe section 221, as shown in FIG. 2.

While the foregoing paragraphs describe a method for cooling the structure 100, embodiments of the present disclosure can also be adapted for heating the structure 100, for example, by reversing the flow of the refrigerant through the compressor 210, evaporator 220 and condenser 230. For example, in one embodiment, to heat the structure 100, the compressor 210 may transfer high pressure, high temperature refrigerant to the evaporator 220. The fan 240 may circulate air within the structure 100 over the coil 224 containing the high temperature, high pressure refrigerant, thereby transferring heat to the air within the structure 100. In some such embodiments, the condenser 230 may receive cooled refrigerant from the evaporator 220 and warm up the refrigerant using air available outside the structure 100. While not shown in FIG. 2, the air conditioning system 110 may, in some embodiments, include any number of additional or alternative components including pipe sections for heating, pipe sections for cooling, valves, filters, expansion valves, reversing valves, filters, driers, fans, and the like to enable operation of the air conditioning system 110.

In some embodiments of the present disclosure, the air conditioning system 110 may include a heat source such as a furnace, boiler, electrical heating element, and the like to provide or assist with heating the structure 100, and controller 120 may be configured to control selection and regulation of the heating, cooling and ventilation by selectively controlling one or more components of the air conditioning system 110.

In one embodiment of the present disclosure, compressor 210, condenser 230 and fan 250 may be placed outside the structure 100, and the evaporator 220 and fan 240 may be placed inside the structure 100. In alternative embodiments, all of the components of the air conditioning system 110 may be placed outside the structure 100, as shown in FIG. 1.

Figure 3:
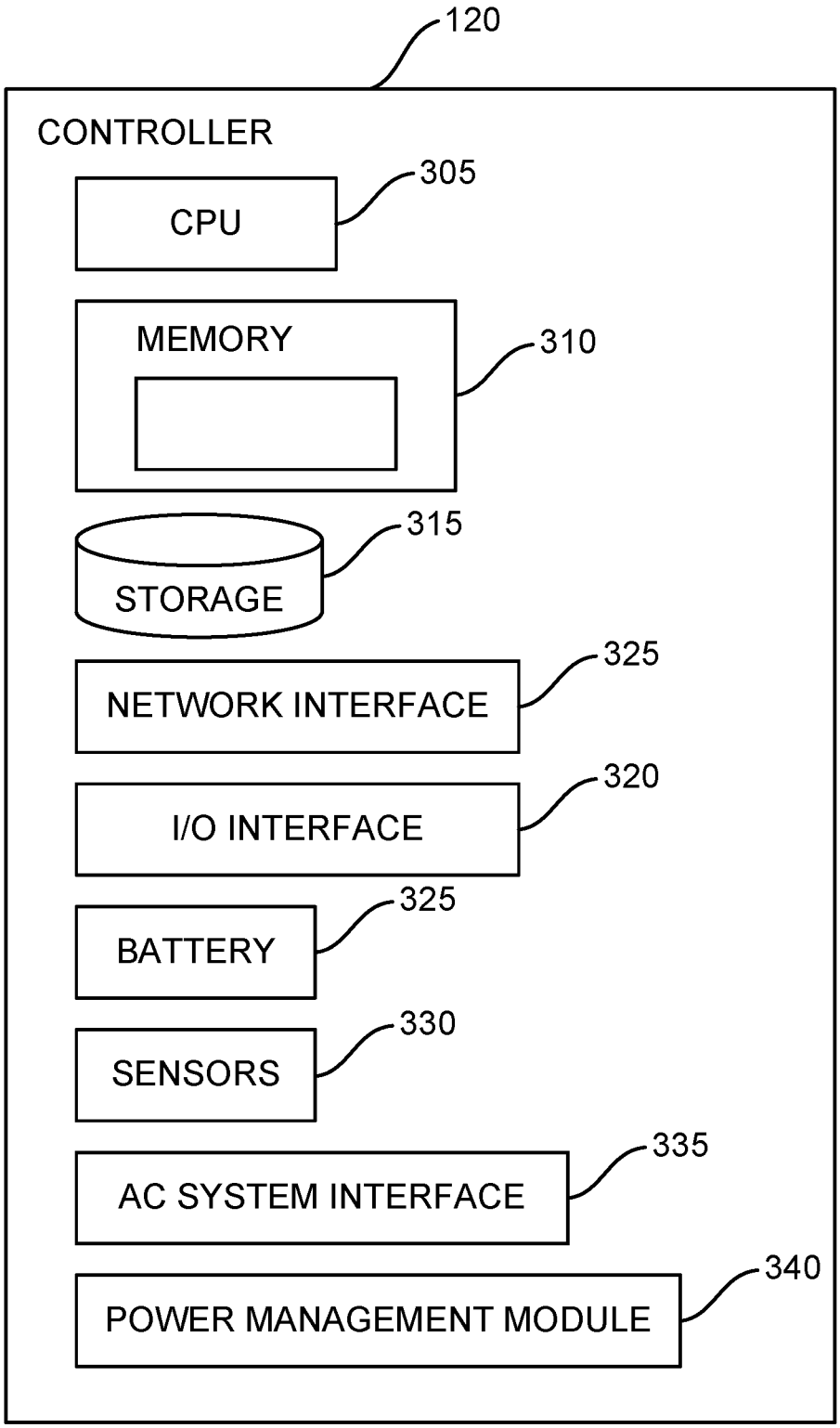
FIG. 3 depicts an example of an air conditioning system controller, according to some embodiments of the present disclosure.

FIG. 3 illustrates an example of a controller 120 according to some embodiments of the present disclosure. As shown in FIG. 3, the controller 120 includes a CPU 305, memory 310, storage 315, a network interface 325, one or more I/O interfaces 320, Battery 325, Sensors 330, air conditioning (AC) system interface 335, and power management module 340. While not shown in FIG. 3, the CPU 305, memory 310, storage 315, network interface(s) 325, I/O interface(s) 320, Battery 325, Sensors 330, air conditioning (AC) system interface 335, and power management module 340 are communicatively coupled by one or more buses.

In the illustrated embodiment, the CPU 305 retrieves and executes programming instructions stored in memory 310, as well as stores and retrieves application data residing in storage 315. The CPU 305 is generally representative of a single CPU and/or GPU, multiple CPUs and/or GPUs, a single CPU and/or GPU having multiple processing cores, and the like.

Memory 310 is generally included to be representative of a random-access memory. Storage 315 may be any combination of disk drives, flash-based storage devices, and the like, and may include fixed and/or removable storage devices, such as fixed disk drives, removable memory cards, caches, optical storage, network attached storage (NAS), or storage area networks (SAN).

According to some embodiments of the present disclosure, the controller 120 can be communicatively coupled with one or more other devices and components via the network interface 325 (e.g., via a network, which may include the Internet, local network(s), Bluetooth, a cellular network, and the like). In one embodiment, the network interface 325 may be used to communicate with a network access point using a wireless protocol including but not limited to 802.11a, 802.11b, 802.11g, 802.11n, or other protocols not specifically listed here. In some embodiments, controller 120 may communicate with a cloud-based storage device over TCP/IP or another network protocol via the network interface 325. A remote user may access thermostat control loop information from the cloud-based storage device using a cellular phone, tablet, or other device capable of communicating with the cloud-based storage device. In this manner, a remote user may have access to temperature and state information while located in a remote location from the air conditioning system 110. A remote user may also communicate information, including but not limited to new desired temperature settings or enable or disable instructions, to the air conditioning system through a wireless connection from user's device to the cloud-based storage device, and on to the controller 120 over a wireless network.

In one embodiment of the present disclosure, the controller 120 may be configured to operate as a network access point configured to connect one or more devices in or near the structure 100 to a network, for example, the internet, a local area network, or the like. In one embodiment, the network interface 325 may include a cellular radio transceiver for communication and may communicate using a cellular protocol, the cellular protocol including but not limited to CDMA, GSM, 3G, 4G, 5G, or other protocols not specifically listed here. In such embodiments, a Subscriber Identity Module (SIM) card may provide cellular network access. In one embodiment of the present disclosure, the controller may operate as an access point for connecting nearby devices such as cell phones, tablets, televisions, audio devices, smart appliances or devices and any other device to a network via the cellular network.

In some embodiments, input and/or output (I/O) devices (such as touchscreens, display screens, keypads, etc.) are connected to controller 120 via the I/O interface(s) 320. The I/O devices may be built-in to the controller 120 in one embodiment of the present disclosure. In some embodiments, the I/O interface may include one or more ports for coupling a variety of external devices to the controller 120, for example, display screens, memory devices, network interface devices, media streaming devices/dongles, etc.

In one embodiment of the present disclosure, the I/O interface 320 may include one or more programmable or customizable relays capable of receiving wired connections or an integrated circuit or chipset capable of wireless communication (e.g., via bluetooth) to control one or more devices other than the air conditioning system 110. For example, in one embodiment a generator may be coupled with the controller wirelessly or by means of one or more wires. The controller 120 may be configured to automatically start and stop the generator based on, for example, availability of power to the structure 110.

In some embodiments of the present disclosure, the relays included in I/O interface 320 may be capable of interfacing with third party Application Programming Interfaces (APIs) for extended functionality or for facilitating user programmable functions to control devices associated with the structure 100. In one embodiment, the relays may be capable of accommodating a variety of wires of different size, electrical capacity, and the like.

In one embodiment of the present disclosure, the I/O interface 320 may be used to communicate instructions and/or data with a user. For example, the controller may use the I/O interface 320 to display or send alerts to the user when a predefined temperature is reached. In some embodiments, the I/O interface may be used to receive user selections for a temperature schedule or timers for the managing the temperature within the structure 100.

In one embodiment of the present disclosure, the AC system interface 335 may be configured to receive one or more input and/or output wires for controlling an air conditioning system, e.g., the air conditioning system 110 described herein. The input and/or output wires may provide power to the controller 120 and facilitate communication of measurements, data and/or operating commands between an air conditioning system 110 and the controller 120. In one embodiment of the present disclosure, the wires may carry electrical signals that enable functions such as adjusting temperatures, setting schedules, activating heating and cooling modes, managing ventilation, and the like. Examples of wires may include a positive wire, a negative wire, common wire, ground, a single wire for communicating control signals, RJ11, RS-485A, RS-485B, and the like. The wires may be of any size or of different sizes according to embodiments of the present disclosure.

As mentioned above, different types of air conditioning systems may utilize different types and numbers of wires, operate at different voltages, use different command signals, measure and/or record different types of data, etc. For example, some air conditioning systems may use a single wire for transferring data and/or commands while other air conditioning systems may use multiple or parallel wires to communicate data and/or commands. In one embodiment of the present disclosure, the AC system interface 335 may be configured to receive input and/or output wires from any type of air conditioning system. Accordingly, in some embodiments, the controller 120 may be configured to convert data and/or commands received over a single wire to data and/or commands transmitted over multiple or parallel wires (or vice versa).

Figure 4:
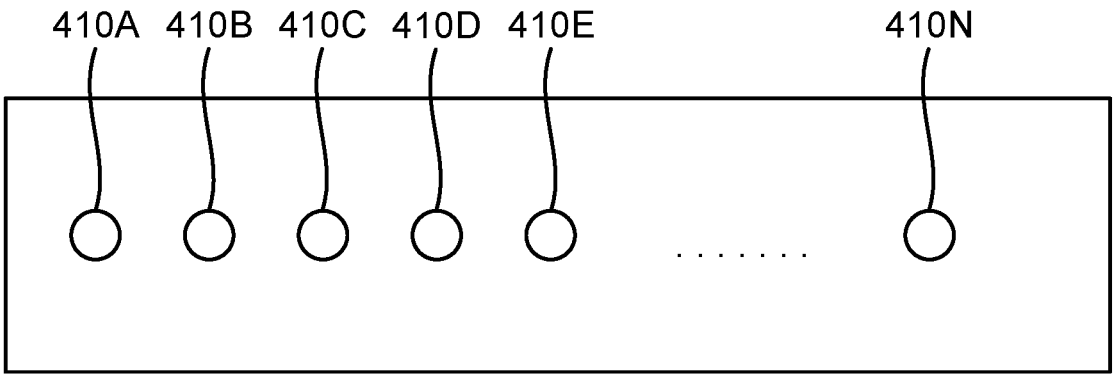
FIG. 4 depicts an example of a controller interface for receiving wires from an air conditioning system, according to some embodiments of the present disclosure.

For example, as shown in FIG. 4, the AC system interface 335 may include a plurality of ports 410A-N configured to receive a plurality of types of wires used across a plurality of different types of air conditioning systems. In one embodiment, Port 410A may be port configured to receive a positive wire and port 410B may be configured to receive a negative wire. In one embodiment, a first air conditioning system may use a positive wire, a negative wire and a single communication wire. Accordingly, the positive wire may be coupled to port 410A and the negative wire coupled to port 410B. In one embodiment, the port 410C may be designed to receive the type of wire and single wire communications typically transmitted on the communication wire of the first air conditioning system. Therefore, in one embodiment, the communication wire of the first air conditioning system may be coupled to port 410C.

In another embodiment of the present disclosure, a second air conditioning system may utilize four wires: positive, negative, RS-485A, and RS-485B. The ports 410D and 410E may be designed to receive RS-485A and RS-485B wires respectively. Accordingly, controller 120 may be coupled to the second air conditioning system by coupling its positive wire to port 410A, its negative wire to port 410B, its RS-485A wire to port 410D and its RS-485B wire to port 410E. By permitting engagement of a plurality of different types of wires from a plurality of different types of air conditioning systems, embodiments of the present disclosure provide a single controller 120 that is compatible with a plurality of different air conditioning system types. While ports 410A and 410B are described as ports for a positive wire and a negative wire, in alternative embodiments, the AC system interface 335 may include any number of positive wire and negative wire ports capable of accommodating wires of different sizes and types.

Referring back to FIG. 3, a battery 325 may provide additional power to the controller 120 during periods of heavy load, including but not limited to periods of network search and high-power amplification during periods of low network signal strength, according to some embodiments of the present disclosure. During such periods of heavy load, including but not limited to periods when network interface 325 is performing a network search, a power management module 340 may switch the power source for the controller 120 from power received via the AC system interface 335 to the battery 325. In some embodiments, the power management module may enhance, or boost power delivered via the AC system interface 335 using the battery 325. In one embodiment of the present disclosure, during periods of normal loads, the power management module 340 may provide the appropriate voltage and current to Battery 325 to keep Battery 325 fully charged.

In one embodiment of the present disclosure, the controller 120 may be configured to receive different types of source power from the air conditioning system 110. For example, in some embodiments, the air conditioning system 110 may provide an alternating-current source supplying a voltage greater than or equal to 7.5 Volts and less than or equal to 32 Volts. In alternative embodiments, the air conditioning system 110 may provide a direct-current source supplying a voltage greater than or equal to 7.5 Volts and less than or equal to 32 Volts. In one embodiment, the power management module 340 may be configured to convert the incoming power supply from the AC system interface 335 into one or more voltages to provide power to other modules and components in the controller 120, including but not limited to CPU 305, memory 310, storage 315, a network interface 325, one or more I/O interfaces 320, Battery 325, Sensors 330. In one embodiment, the controller may be configured to convert power to send electrical signals such as commands or other input for air conditioning system 110.

The sensors 330 may include a temperature sensor in one embodiment of the present disclosure. For example, the sensors 330 may include thermistor, thermocouple, or any other apparatus of device capable of measuring ambient temperature. The measurement from a temperature sensor may be used by the controller 120 to activate one or more components of the air conditioning system 110 to heat, cool and/or ventilate to achieve a desired temperature.

In one embodiment of the present disclose, the sensors 330 may include a motion detector which may be used to detect presence of a person, for example, in the structure 100 or near the controller 120. In one embodiment, the measurements from a motion detector sensor 330 may be used to set a temperature for the structure 100 or otherwise activate one or more components of the air conditioning system 110. In some embodiments, a motion detector sensor 330 may be configured to activate a display of the controller 120 to display, for example, an internal temperature of structure 100, outside temperature, weather conditions, weather forecast, date, time, and the like.

In the embodiment illustrated in FIG. 3, the memory 310 includes an operating component 311, which may cause the controller 120 to perform one or more operations described in the embodiments discussed above. Although depicted as a discrete component for conceptual clarity, in embodiments, the operations of the depicted component (and others not illustrated) may be combined or distributed across any number of components. Further, although depicted as software residing in memory 310, in embodiments, the operations of the depicted component (and others not illustrated) may be implemented using hardware, software, or a combination of hardware and software.

Figure 5:
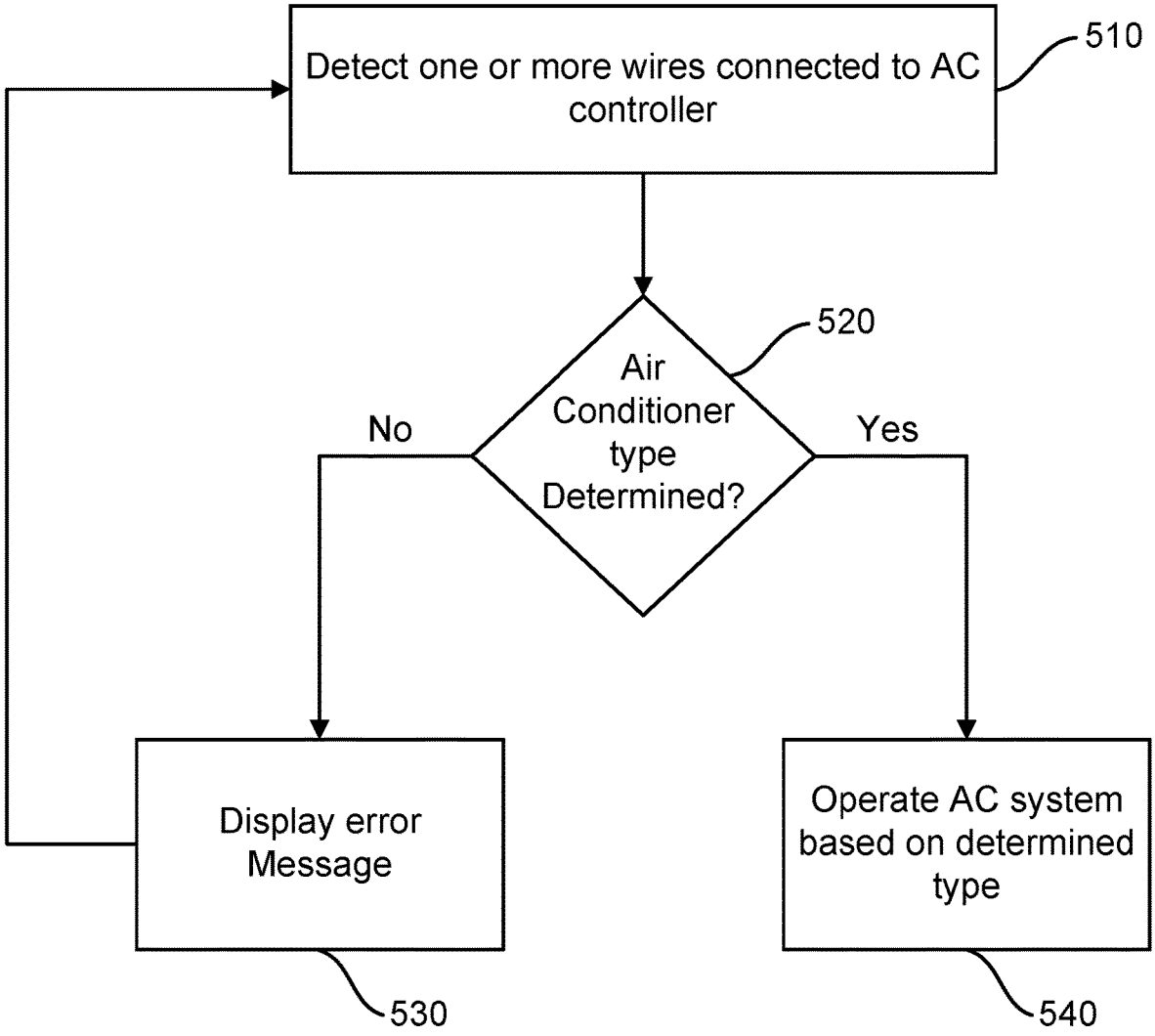
FIG. 5 is a flow diagram depicting an example of a method used by an air conditioning controller, according to some embodiments of the present disclosure.

FIG. 5 is a flow diagram of an example method 500 performed by a controller 120, according to some embodiments of the present disclosure. The method 500 may be performed, for example, when the CPU 305 retrieves and executes programming instructions associated with the operating component 311, in one embodiment. The operations may begin in step 510 by detecting one or more wires connected to the controller 120. For example, one or more wires connected to the AC system interface 335 may be detected.

In some embodiments, the controller 120 may store a database of different types of air conditioning systems (e.g., in the storage 315), their modes of operation, command sets and other operational characteristics, the number and types of wires of the air conditioning systems, the power requirements and outputs of the air conditioning systems, the appropriate AC system interface 350 ports to which wires of each air conditioning system type should be connected to, etc. In some embodiments, the controller 120 may be configured to update and/or modify such database by downloading data from a network, e.g., via the network interface 325.

In one embodiment, at block 520, the controller 120 may be configured to determine whether the wires of the air conditioning system are properly coupled to the controller 120 at the appropriate ports by determining whether the air conditioning system type can be identified. For example, based on one or more of the ports to which the wires are connected, the type of wire detected, the voltage and/or current carried on the wires, the controller 120 may determine the type of air conditioning system that is connected to the controller 120.

In some embodiments of the present disclosure, the controller 120 may be configured to prompt the user for input that may assist with identifying the air conditioning system that is coupled to the controller 120. Examples of user input may include manufacturer name, model number, system type, and the like. In one embodiment, the controller 120 may be configured to prompt the user for input on a display screen of the controller 120 or on a user device such as a phone, tablet, television, or other screen. The controller 120 may identify the air conditioning system coupled thereto based on the detected wires as well as the user input, in one embodiment. In some embodiments, if the detected wires do not comport with the user input, the controller 120 may be controller 120 may determine that there is an installation error.

If the air conditioning system type is not identified at block 520, then at block 530, the controller 120 may display an error message, for example on a display screen of the controller 120. In some embodiments, the error message may be broadcast to a mobile phone, tablet, or other remote screen of a user via a network. In one embodiment, in addition to the error message, the controller 120 may suggest an appropriate remedy for correcting the error. For example, the controller may identify incorrectly placed wires, suggest alternative ports for certain wires, or the like. In some embodiments, the controller may display a diagram or image identifying the error and or proposed solutions on a display screen. In one embodiment, the method may return to step 510 after displaying an error message in step 530, as shown in FIG. 5.

If the air conditioning type is identified at block 520, then at block 540, the controller 120 may begin operating the air conditioning system based one or more of a set of commands, operating modes, etc. associated with the identified air conditioning system. Operating the identified air conditioning system may involve, for example, sending and/or receiving signals to the air conditioning system via the AC system interface 335 at the voltage and current levels associated therewith, employing a command set and/or modes of operation associated with the identified air conditioning system, converting single wire data and/or command signals from serial to parallel (or vice versa), and the like.

In the current disclosure, reference is made to various embodiments. However, the scope of the present disclosure is not limited to specific described embodiments. Instead, any combination of the described features and elements, whether related to different embodiments or not, is contemplated to implement and practice contemplated embodiments. Additionally, when elements of the embodiments are described in the form of "at least one of A and B," or "at least one of A or B," it will be understood that embodiments including element A exclusively, including element B exclusively, and including element A and B are each contemplated. Furthermore, although some embodiments disclosed herein may achieve advantages over other possible solutions or over the prior art, whether or not a particular advantage is achieved by a given embodiment is not limiting of the scope of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, the embodiments disclosed herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a computer program product embodied in one or more computer readable medium(s) having computer readable program code embodied thereon.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations and/or block diagrams of methods, apparatuses (systems), and computer program products according to embodiments presented in this disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block(s) of the flowchart illustrations and/or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations and/or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the block(s) of the flowchart illustrations and/or block diagrams.

The flowchart illustrations and block diagrams in the Figures illustrate the architecture, functionality, and operation of possible implementations of systems, methods, and computer program products according to various embodiments. In this regard, each block in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

In view of the foregoing, the scope of the present disclosure is determined by the claims that follow.

What is claimed is:

1. A controller, comprising:

an interface comprising a plurality of ports including a first port configured to receive wires of a first wire type associated with a first air conditioning system type and a second port configured to receive wires of a second wire type associated with a second air conditioning system type, wherein the first air conditioning system type and the second air conditioning system type are used in recreational vehicles;

at least one processor; and a memory containing a program which when executed by the one or more computer processors performs an operation, the operation comprising:

detecting that a wire of the first wire type has been coupled to the interface;

determining that a first air conditioning system coupled to the controller is a first air conditioning system type based, in part, on the detected wire of the first wire type;

operating the first air conditioning system based on the determination that the first air conditioning system is the first air conditioning system type;

detecting that a wire of the second wire type has been coupled to the interface;

determining that a second air conditioning system coupled to the controller is the second air conditioning system type based, in part, on the detected wire of the second wire type; and operating the second air conditioning system based on the determination that the second air conditioning system is the second air conditioning system type.

2. The controller of claim 1, wherein the operation further comprises:

determining an installation error based on detecting that the wire of the first wire type has been coupled to the interface; and in response to determining the installation error, causing an error message to be displayed on a display screen.

3. The controller of claim 2, wherein the operation further comprises, in response to determining the installation error, displaying a solution to resolve the installation error on the display screen.

4. The controller of claim 1, further comprising one or more relays for coupling one or more devices configured to be controlled by the controller.

5. The controller of claim 1, wherein the operation further comprises:

receiving user input describing one or more features of the first air conditioning system, wherein the determining that the first air conditioning system coupled to the controller is the first air conditioning system type is based, in part, on the received user input.

6. The controller of claim 1, further comprising a network interface for coupling the controller to a network, and wherein the operation further comprises coupling a device capable of wireless communication to the network using the network interface.

7. The controller of claim 6, wherein the device capable of wireless communication controls the operation of a system that is not an air conditioning system.

8. The controller of claim 1, further comprising a power management module configured to convert electrical power received over the wire of the first wire type.

9. A method, comprising:

detecting, by a controller, that a wire of the first wire type has been coupled to an interface of the controller, wherein the interface is configured to receive wires of a first wire type that is associated with a first air conditioning system type and the interface is configured to receive wires of a second wire type associated with a second air conditioning system type, wherein the first air conditioning system type and the second air conditioning system type are used in recreational vehicles or other mobile dwellings;

determining, by the controller, that an air conditioning system coupled to the controller is the first air conditioning system type based, in part, on the detected wire of the first wire type;

operating the air conditioning system based on the determination that the air conditioning system is the first air conditioning system type.

10. The method of claim 9, further comprising:

determining an installation error based on detecting that the wire of the first wire type has been coupled to the interface; and in response to determining the installation error, causing an error message to be displayed on a display screen.

11. The method of claim 10, further comprising:

in response to determining the installation error, displaying a solution to resolve the installation error on the display screen.

12. The method of claim 9, further comprising connecting the controller to a network via a network interface, and further comprising coupling a device capable of wireless communication to the network using the network interface.

13. The method of claim 12, wherein the device capable of wireless communication controls the operation of a system that is not an air conditioning system.

14. The method of claim 9, further comprising controlling one or more devices coupled with the controller via one or more relays.

15. The method of claim 9, further comprising:

receiving user input describing one or more features of the air conditioning system, wherein the determining that the first air conditioning system coupled to the controller is the first air conditioning system type is based, in part, on the received user input.

16. A non-transitory computer-readable medium containing computer program code that, when executed by operation of one or more computer processors, performs an operation, comprising:

detecting that a wire of a first wire type has been coupled to an interface of a controller, wherein the interface is configured to receive wires of a first wire type that is associated with a first air conditioning system type, wherein the interface is configured to receive wires of a second wire type that is associated with a second air conditioning system type, and wherein the first wire type is of a first wire size and the second wire type is of a second wire size;

determining that an air conditioning system coupled to the controller is the first air conditioning system type based, in part, on the detected wire of the first wire type, wherein the first air conditioning system type is used in recreational vehicles; and operating the air conditioning system based on the determination that the air conditioning system is the first air conditioning system type, wherein operating the air conditioning system comprises transceiving signals with the air conditioning system to enable thermostat functions in place of an original thermostat of the air conditioning system.

17. The non-transitory computer-readable medium of claim 16, wherein the second wire size is RJ11 and the first wire size is not RJ11.

18. The non-transitory computer-readable medium of claim 16, the operation further comprising:

determining an installation error based on detecting that the wire of the first wire type has been coupled to the interface; and in response to determining the installation error, causing an error message to be displayed on a display screen.

19. The non-transitory computer-readable medium of claim 16, wherein the operation further comprises connecting the controller to a network via a network interface, and wherein the operation further comprises coupling a device capable of wireless communication to the network using the network interface.

20. The non-transitory computer-readable medium of claim 19, wherein the device capable of wireless communication controls the operation of a system that is not an air conditioning system.

* * * * *